US007531235B2

(12) United States Patent
Den Toonder et al.

(10) Patent No.: US 7,531,235 B2
(45) Date of Patent: May 12, 2009

(54) FIBRE OR FILAMENT

(75) Inventors: Jacob M. J. Den Toonder, Helmond (NL); Johannes T. A. Wilderbeek, Veghel (NL); Jan M. Krans, Den Bosch (NL); Michel P. B. Van Bruggen, Helmond (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 177 days.

(21) Appl. No.: 10/596,484

(22) PCT Filed: Dec. 14, 2004

(86) PCT No.: PCT/IB2004/052807

§ 371 (c)(1),
(2), (4) Date: Jun. 15, 2006

(87) PCT Pub. No.: WO2005/061764

PCT Pub. Date: Jul. 7, 2005

(65) Prior Publication Data

US 2007/0195546 A1 Aug. 23, 2007

(30) Foreign Application Priority Data

Dec. 20, 2003 (GB) ..... 0329567.2

(51) Int. Cl.
*D02G 3/36* (2006.01)

(52) U.S. Cl. ..... 428/375; 428/364; 428/373; 428/392; 428/394; 428/397; 428/400; 428/401

(58) Field of Classification Search ..... 428/364, 428/373, 375, 392, 394, 397, 400, 401
See application file for complete search history.

(56) References Cited

U.S. PATENT DOCUMENTS 4,681,791 A * 7/1987 Shibahashi et al. ..... 428/96
5,824,996 A * 10/1998 Kochman et al. ..... 219/529
6,287,485 B1 * 9/2001 Akashi et al. ..... 252/583

* cited by examiner

*Primary Examiner*—Andrew T Piziali

(57) ABSTRACT

A filament or fiber (2) comprising a volume modulation coloration producing substance (6); containment means (8) for containing the substance in the form of an elongated core which containment means is at least partially light transmitting; and stimulation means (4) for stimulating the substance to produce a change in the volume of the substance, thereby changing the color of the filament or fiber.

30 Claims, 4 Drawing Sheets

FIBRE OR FILAMENT

This invention relates to a fibre or filament, especially one that is suitable for inclusion in a fabric or garment with the aim of producing optically detectable effects therein.

Various methods of producing colour changing, or light emitting fibres are known.

One known method uses perforated optical fibres that "leak" light through perforations when light is fed into one end of the fibre. A disadvantage of this method is that an external light source such as an LED is needed.

Other known methods also make use of specific thermochromic materials, i.e., materials that change colour under the influence of a change in temperature. Such a method is disclosed in European patent publication No. EP 0410415. For many applications it is a disadvantage that no direct use can be made of an electrical stimulus, and that the ambient temperature influences the effect.

Another known method is based on the use of an electroluminophor material, which emits light under the influence of an electric field. Such a method is described in UK patent application No. GB 2 273 606 and International patent application No. WO 97/15939. Integrating at least two electrodes in a fibre creates the electric field used in such methods.

Although it is possible to achieve active control of the colour of fibres using this method, it is necessary to apply a high voltage to the fibres in order to achieve colour change. Further, the method produces fibres having poor contrast in daylight, because the electroluminescent effect is light emitting.

The present invention relates particularly to the field of wearable electronics. This field aims at integrating specific functions such as sensing, actuating, light emitting, and colour changing into garments. It is particularly desirable to be able to integrate colour changing properties into textiles for the formation of garments, furnishings etc. Such technology could be used to make wearable displays, wearable indicators, and also to simply cause a change of colour or pattern to textiles for aesthetic reasons.

It is known to produce a wearable display by interweaving conductive fibres and fibres containing electro optical material. A problem with such displays is that the light emitting effect is not integrated into a single fibre. This means that the effect is not uniform across the garment or other work formed from the fibres. In addition it is necessary to use either two sets of interwoven fibres containing conductive elements, or additional conductive layers deposited on the woven structure.

It is an object of the present invention to provide a fibre or filament in which the colour changing function is integrated into the single fibre or filament, and wherein the colour change can be actively controlled.

It is another object of the present invention to achieve colour change at low applied voltages, and to achieve good colour contrast.

It is a further object of the present invention to create a fabric from a fibre or filament according to the present invention which fabric may be used to form, for example, garments or furniture.

According to a first aspect of the present invention there is provided a filament or fibre comprising:

a volume modulation colouration producing substance;

containment means for containing the substance in the form of an elongated core which containment means is at least partially light transmitting; and stimulation means for stimulating the substance to produce a change in the volume of the composition, thereby changing the colour of the fibre.

By means of the present invention, therefore, true integration of the colour change or light emission of the fibre or filament can be achieved since the colour changing function is integrated into a single fibre, filament or thread.

In addition, the colour change in the fibre or filament of the present invention can be actively controlled, and requires lower voltage than that necessary in the known methods described herein above. Typically, colour change may be achieved in a fibre or filament according to the present invention with a voltage of around 10 mV.

Further, due to the use of the volume modulation coloration producing substance, colour change is achieved using a reflective principle. This means that good contrast in daylight is achieved.

The substance may comprise any known volume modulation colouration producing substance, for example, of the type described in U.S. Pat. No. 6,287,485.

Such light modulation materials imitate the behaviour of pigment cells found in nature. Cephalopods such as squids and octopuses have an ability to change their skin colour and pattern rapidly. This phenomenon is due to pigment cells present in their skin. This type of pigment cell consists of an elastic pigment bag, which contains a colorant, and plural muscle fibres. The mechanism for changing the colour is based on diffusion and aggregation of colorant that leads to the reversible alteration of the size of the coloured bag with the motion of the muscles. When the pigment bags expand, the colours appear, and when they contract, the colours bleach out.

Based on this principle of natural pigment cells, materials have been designed that mimic their colour changing mechanisms (see R. Akashi, H. Tsutsui, A. Komura: Polymer gel light emitting modulation imitating pigment cells, Adv. Mater. 2002, Vol. 14, No. 24, pp. 1808-1811).

The materials are stimuliresponsive gels containing a high concentration of colorants, such as pigments. They demonstrate reversible volume phase transitions in response to external stimuli such as change in temperature, pH, light, or electric field.

Volume changes of over 350 times have been observed for temperature induced transitions, whereas volume changes in certain gels of up to 100 times have been measured due to applied electric fields as low as 1 V/cm.

The mechanism of the light modulation is due to a reversible colour change, i.e., the light modulation is caused by a synergetic effect between the change of area of light absorption and the absorption efficiency of the colorants in the gels.

The volume modulation colouration producing substance may be, for example, a liquid, gel, or other composition containing volume modulation colouration producing material.

Advantageously, the substance comprises an aqueous solution in which is immersed polymer gel particles. The polymer gel particles comprise artificial pigment cells, and preferably have a diameter falling within the range of 5 to 100 μm.

Preferably, the concentration of pigment cells within the aqueous solution is typically 5 to 40 wt %, and the gel solid content in the solution is typically 1 to 10 wt %.

When stimulated by the stimulation means, the gel particles swell, essentially by taking up surrounding liquid from the aqueous solution. This means that the overall volume of the substance remains substantially the same, with only the volume taken by the gel particles increasing.

Conveniently, the stimulation means comprises heating means for heating the substance, which substance comprises a volume modulation colorant, the volume of which changes with temperature. The heating means may be in the form of, for example, an inner electrode extending substantially axially through the elongate core.

Advantageously, the inner electrode is spaced apart from the containment means by a distance ranging from tens of μm to hundreds of μm, for example 100 μm.

Preferably, the filament or fibre further comprises means for causing an electric current to flow through the heating means thereby causing a heating effect in the filament or fibre which in turn causes the substance to change volume and therefore change colour.

Alternatively, the stimulation means comprises electric means for applying an electric field across the substance, which substance comprises a volume modulation colorant, the volume of which changes with electric field.

The electric means may comprise for example, a pair of electrodes each extending along an outer surface of the elongate core. The filament or fibre further comprises an at least partially light transmitting isolating coating at least partially enclosing the electrodes.

Preferably, the electrodes are entwined and each extends substantially helically along the core.

Alternatively, the electric means may comprise an inner electrode extending substantially axially through the core, and an outer electrode forming the containment means, the filament or fibre further comprising a light transmitting isolating coating at least partially enclosing the second electrode.

In such an embodiment, the second electrode effectively forms the sheath to the filament or fibre, and preferably is formed from conductive polymer such as poly(ethylenedioxythiophene) (PEDOT) or polyaniline (PANI).

Preferably, the fibre or filament further comprises spacer means for maintaining the fibre in a predetermined shape. Depending on the nature of the volume modulation coloration producing substance, it can be advantageous to include spacers in the filament or fibre particularly if the substance has a liquid like form and therefore will not have a self maintaining shape.

The spacer means are preferably formed from a nonconductive material and may be in the form of, for example, elongate wires or substantially spherical beads.

In embodiments of the invention comprising an inner electrode extending substantially axially along the core, the spacer means may define the distance between the inner electrode and the sheath. In embodiments of the invention comprising an outer electrode, the spacer means will extend between the inner electrode and the outer electrode.

Advantageously, the spacer means comprises one or more wires extending substantially helically along the inner electrode.

Advantageously, the diameter of the one or more wires is between tens of μm and hundreds of μm, for example 100 μm. The diameter of the one or more wires will define the thickness of the colour change layer formed by the substance.

Alternatively, the spacer means comprises a plurality of substantially spherical beads positioned within the substance, or deposited onto the inner electrode. Advantageously, the beads have a diameter between tens of μm and hundreds of μm, for example 100 μm.

The spacer means is particularly advantageous in embodiments of the invention comprising an inner electrode and an outer electrode. The spacer means prevents the fibre or filament from collapsing in on itself, and thus prevents the inner electrode and the outer electrode making contacting with one another.

Advantageously, the containment means comprises an outer sheath, preferably being at least partially transparent. However the outer sheath could alternatively be opaque.

Conveniently, the outer sheath is formed from a flexible polymer. Preferably, the containment means comprises a substantially elongate member formed from an extruded polymer. Preferably, the elongate member comprises an inner substantially cylindrical hollow portion, and an outer substantially cylindrical portion which is substantially coaxial with the first portion.

Conveniently, the first portion defines within it, an inner electrode housing. Further a space is defined between the inner and outer portions which space is adapted to contain the substance.

Advantageously, the elongate member further comprises one or more radial sections extending from the inner portion to the outer portion to define a plurality of cavities, each of which may contain the substance.

The radial sections may be substantially solid, thus preventing movement of the substance between cavities. In such an embodiment, the substance in each cavity may be chosen to produce a different colour on stimulation.

Alternatively, the radial sections may allow communication between one or more of the cavities.

Advantageously, the elongate member further comprises a conductive core forming the inner electrode positioned within the inner electrode housing, and coextruded with the elongate member.

According to the second aspect of the present invention there is provided a method of forming a fibre or filament comprising the steps of:

forming a containment means for containing a volume modulation coloration producing substance in the form of an elongate core;

associating with the containment means a stimulation means for stimulating the volume modulation coloration producing substance; and adding a volume modulation coloration producing substance to a space defined by the containment means; and sealing the containment means.

Preferably, the step of forming the containment means, and the step of associating the stimulation means with the containment means are combined into a single step comprising coextruding a conductive material in the form of a central elongate core with a nonconductive material in the form of a first hollow elongate portion surrounding the conductive elongate core, and a second coaxial hollow elongate portion spaced apart from the first elongate portion, the first elongate portion and the second elongate portion being joined by one or more radially extending sections extending from the first elongate portion to the second elongate portion.

Advantageously the method comprises the further steps of depositing on an outer surface of the outer elongate portion a transparent conductive layer. Preferably, the method comprises a further step of depositing on an outer surface of the transparent conductive layer, a transparent protective and isolating coating.

The invention will now be further described by way of example only with reference to the accompanying drawings in which.

Figure 7A:
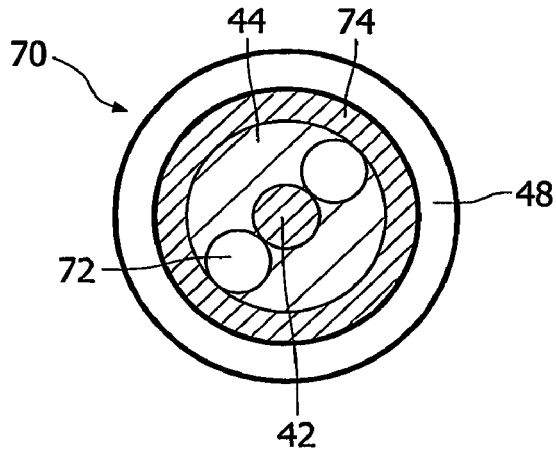
Figure 7B:
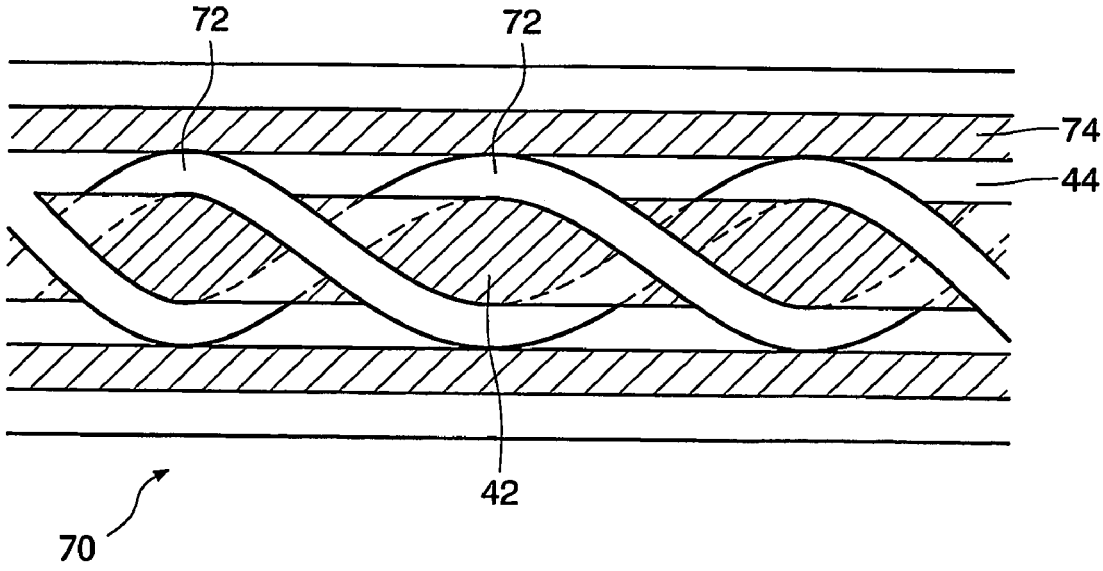
Figure 8A:
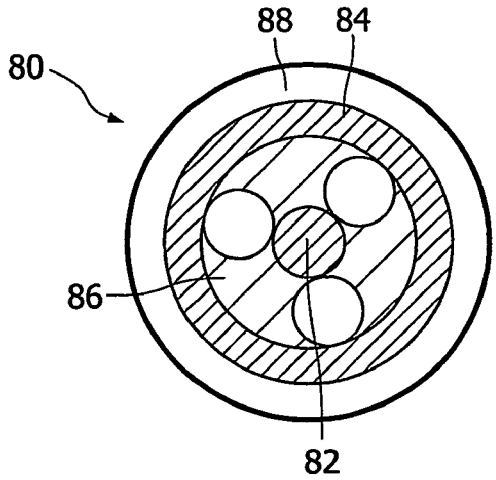
Figure 8B:
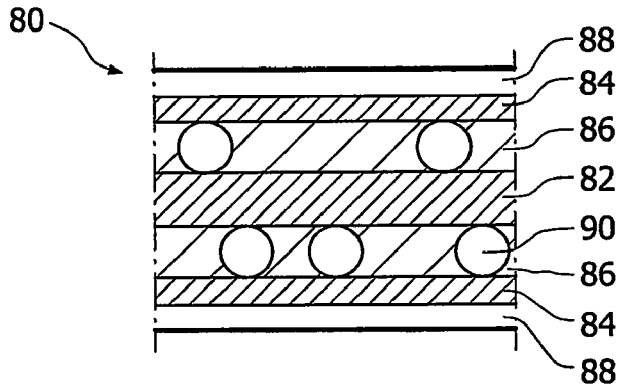
Figure 9:
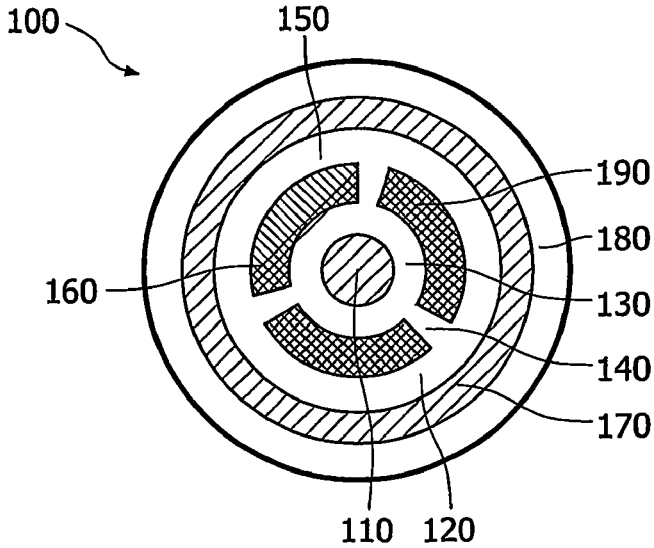

FIGS. 7*a* and 7*b* are schematic representations of a fourth embodiment of a fibre according to the present invention;

FIGS. 8*a* and 8*b* are schematic representations of a fifth embodiment of the fibre according to the present invention; and FIG. 9 is a schematic representation of a sixth embodiment of a fibre according to the present invention.

Figure 1:
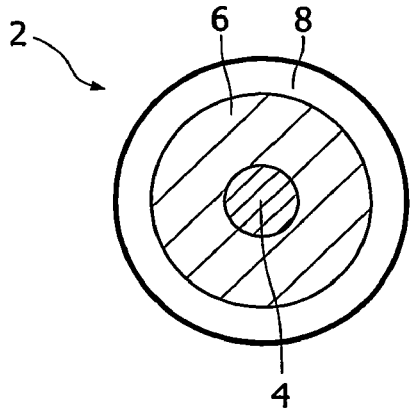
FIG. 1 is a cross sectional representation of a first embodiment of a fibre according to the present invention.
Figure 2:
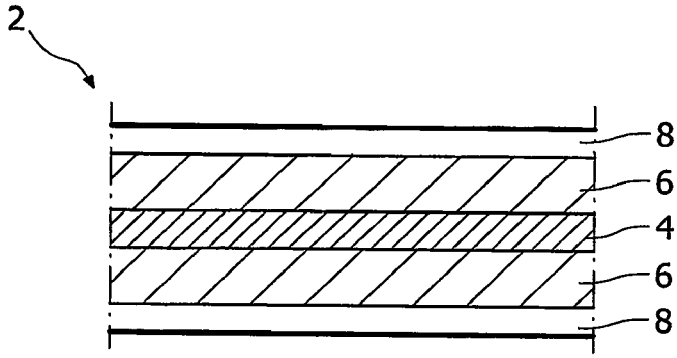
FIG. 2 is a cross sectional representation of the fibre of FIG. 1.

Referring first to FIGS. 1 and 2, a fibre according to the present invention is designated generally by the reference numeral 2. The fibre 2 comprises stimulation means in the form of an electrode 4 extending substantially centrally along the axis of the fibre 2.

The fibre 2 further comprises a volume modulation colouration producing substance 6 containing a volume modulation colorant in the form of artificial pigment cells. The substance is held within containment means 8 the form of a sheath that is transparent and is formed from a flexible polymer. The electrode is formed from any suitable material such as copper. When a current is caused to flow through the electrode 4, the electrode heats due to its resistance. This heat induces a temperature increase in the substance 6 which stimulates a volume change in the pigment cells (not shown) immersed in a solution. This in turn causes a colour change. Because the sheath 8 is transparent, the colour change is visible along the length of the fibre 2. The pigment cells are contained within polymer gel particles immersed in an aqueous solution.

Typically the gel particles each have a diameter falling with the range of 5 to 100 μm, and the radial depth of the substance 2 is between tens of μm and hundreds of μm, typically about 100 μm.

Figure 3:
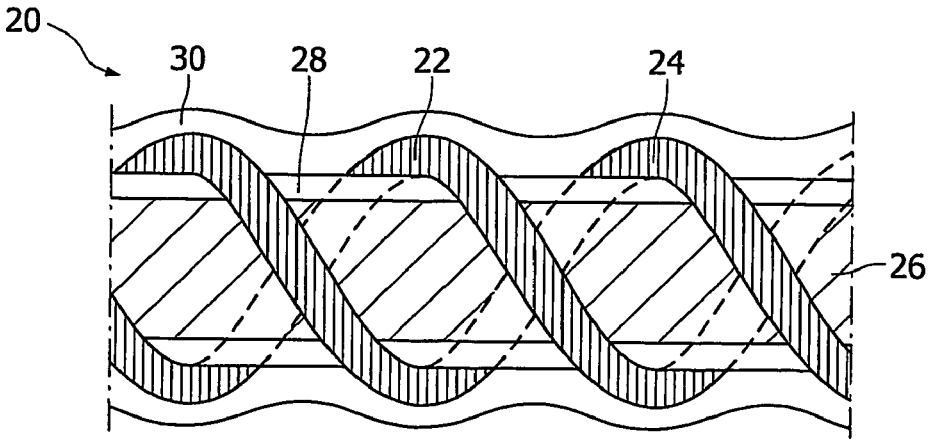
FIG. 3 is a schematic representation of a second embodiment of a fibre according to the present invention.
Figure 4:
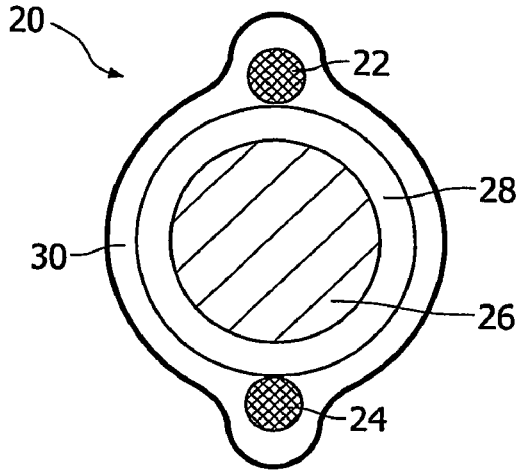
FIG. 4 is a cross sectional representation of the fibre of FIG. 3.

Turning now to FIGS. 3 and 4, a second embodiment of a fibre according to the present invention is designated generally by the reference numeral 20. The fibre 20 comprises two electrodes 22, 24 which are entwined with one another and extend axially along the fibre 20. Each electrode 22, 24 extends substantially helically along the fibre 20. The fibre 20 further comprises a volume modulation colouration producing substance 26 containing pigment cells (not shown) encased in an outer sheath 28. By applying a voltage difference between the two electrodes 22, 24 an electric field is induced that stimulates a volume change in the pigment cells, resulting in a colour change. A transparert isolating coating 30 is applied around the electrodes 22, 24. The diameter of the sheath 28 is between tens of μm and hundreds of μm, typically 100 μm.

Figure 5:
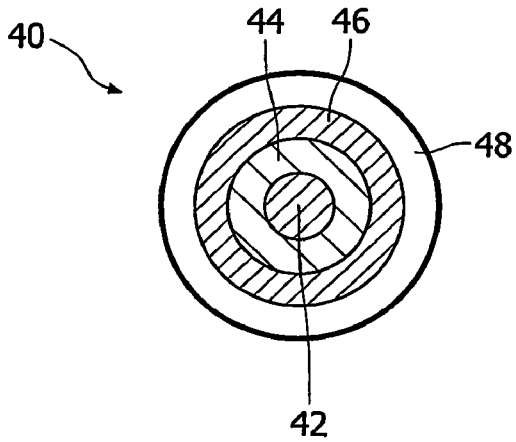
FIG. 5 is a cross-sectional representation of a third embodiment of a fibre according to the present invention.
Figure 6:
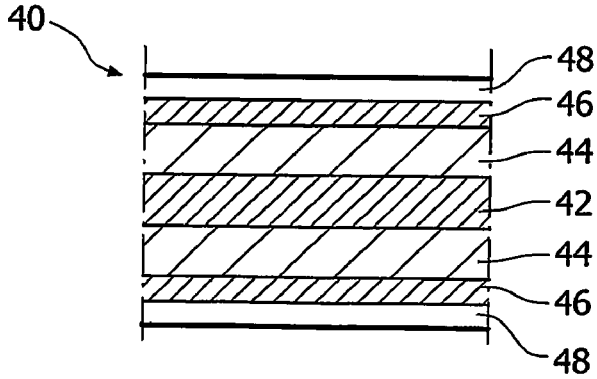
FIG. 6 is a schematic representation of the fibre of FIG. 5.

Turning now to FIGS. 5 and 6, a third embodiment of a fibre according to the present invention is designated generally by the reference numeral 40. The fibre 40 comprises a central electrode 42, which is surround by a volume modulation colouration producing substance 44 containing pigment cells (not shown). A second electrode 46 is in the form of a shell and therefore acts also as the containment means. The second electrode is preferably made of a transparent conductive material such as ITO (Indium Tin Oxide). However, this material has limited flexibility since it breaks at relatively low strains (typically 2%). To maintain the flexibility of the fibre, the electrode 46 could be formed from a conductive polymer such as PEDOT or PANI. An electric field is created by applying a voltage difference between electrodes 42 and 46 which stimulates a volume change of the pigment cells, and hence a colour change to the fibre 40. The fibre further comprises a transparent isolating sheath 48, which encloses the electrode 46.

In the first and third embodiments of the invention described herein above, an optional coloured layered may be added to the central electrode (4; 42). Such an embodiment will enable switching between a state in which the colour of the coloured layered is visible, and a second state in which the colour of the pigment cells is visible upon volume increase of these cells. The colour of the layer may be freely chosen, as may the colour of the pigment within the pigment cells. However, the colour of the pigment must be different from the colour of the layer.

Turning now to FIGS. 7*a* and 7*b*, a fourth embodiment of a fibre according to the present invention is designated generally by the reference numeral 70. The fibre 70 is similar to fibre 40 (FIGS. 5 and 6), and parts corresponding to those parts shown in FIGS. 5 and 6 have been given corresponding reference numerals for ease of understanding.

The fibre 70 further comprises spacers in the form of spacer wires 72. The spacer wires 72 ensure the existence of a well-defined thickness to the volume of the substance 6. This may be necessary since the substance 6 has liquid like properties and therefore has no fixed shape. The spacers in this embodiment are in the form of one or more wires, which are entwined around the inner electrode 42. The distance between the electrode 42, and electrode 74 is defined by the diameter of the spacer wires 72. In the illustrated embodiments, the diameter of each spacer wire is between tens of μm to hundreds of μm, typically 100 μm. The spacer wires should be nonconductive to prevent short-circuiting between the inner and outer electrodes.

Referring to FIGS. 8*a* and 8*b*, a fifth embodiment of a fibre according to the present invention is designated generally by the reference numeral 80. The fibre 80 comprises a central electrode 82, surrounded by a volume modulation coloration producing substance 86, outer electrode 84, and outer sheath 88. The fibre 80 further comprises spacers 90 in the form of substantially spherical spacer beads positioned in the substance 86. The diameter of each of the beads 90 is substantially equal to the desired distance between the inner electrode 82 and the outer electrode 84. This in turn defines the thickness of the substance 86 which is typically between tens of μm and hundreds of μm, for example 100 μm. The spacing spheres 90 should be nonconductive to prevent short-circuiting between the inner and outer electrodes. The beads may either be incorporated within the substance 86, or may be deposited directly on the inner electrode 82.

Referring now to FIG. 9, a schematic representation of a sixth embodiment of a fibre according to the present invention is designated generally by the reference numeral 100. The fibre 100 is made by coextrusion. At least two materials are used in the extrusion process: a conductive material forming an inner electrode 110, and a nonconducting material forming a sheath 120. The nonconducting material may, for example, be a polymeric material.

The sheath 120 is shaped to at least substantially enclose the central electrode 110 by means of an inner, substantially cylindrical portion 130. The sheath further comprises radial sections 140 spaced apart from one another which extend from the central portion 130 to an outer substantially cylindrical portion 150 which is substantially coaxial with portion 130. The sheath 120 therefore defines cavities 160 extending along the length of the fibre 100. The cavities may be isolated from one another, or the substance may be able to move between cavities.

Such a geometry can be obtained by using known techniques of coextrusion through a spinneret. The fibre 100 further comprises a transparent conductive layer 170 made, for example, from ITO or a conductive polymer, and a transparent protective and isolating coating 180. The layer 170 and the coating 180 are deposited around the extruded sheath 120. The cavities 160 are then filled with a volume modulation coloration producing substance 190 by, for example, capillary filling.

Although FIG. 9 shows a fibre 100 with three cavities 160, it is to be understood that other geometries and different numbers of cavities are also possible. The sheath 180 adds strength and structure to the fibre 100.

It is to be understood that other possible combination of central electrode and/or shell electrode with, for example, wound electrodes shown in FIG. 3 are possible in order to create an electric field.

The pigment in the pigment cells can be varied to obtain different colours. A colour changing textile can be obtained by interweaving various sets of fibres with different colour characteristics or pigments and controlling each set separately.

The invention claimed is:

1. A filament or fiber comprising:

a volume modulation coloration producing substance;

an at least partially light transmitting outer sheath that is configured to form an elongated core that contains the substance; and an inner electrode axially located within the core that is configured to stimulate the substance to produce a change in the volume of the substance, thereby changing the color of the filament or fiber.

2. The filament or fiber of claim 1, wherein the substance includes a volume modulation colorant.

3. The filament or fiber of claim 2, wherein the volume modulation colorant includes artificial pigment cells.

4. The filament or fiber of claim 2, wherein the volume modulation colorant includes polymer gel particles, which particles are immersed in an aqueous solution, the polymer gel particles and aqueous solution together forming the substance.

5. The filament or fiber of claim 3, wherein the polymer gel particles have a diameter falling within the range of 5 to 100 μm.

6. The filament or fiber of claim 4, wherein a concentration of pigment cells within the aqueous solution is between 5 and 40 wt %, and a concentration of gel solid content is in the range of 1 to 10 wt % of the aqueous solution.

7. The filament or fiber of claim 4, wherein the outer sheath includes a flexible polymer.

8. The filament or fiber of claim 7, wherein the outer sheath is transparent.

9. The filament or fiber of claim 1, wherein the outer sheath is formed from a substantially flexible polymer.

10. The filament or fiber of claim 2, wherein the electrode is configured to heat the substance, and a volume of the volume modulation colorant changes with temperature.

11. The filament or fiber of claim 10, wherein the inner electrode extends substantially axially through the elongated core.

12. The filament or fiber of claim 10, including a source of electrical current that flows through the inner electrode.

13. The filament or fiber of claim 11, wherein the inner electrode is spaced apart from the outer sheath by a distance between 20 μm and 900 μm.

14. The filament or fiber of claim 2, including an electric source coupled to the inner electrode that provides an electric field across the substance, and a volume of the volume modulation colorant changes with the electric field.

15. The filament or fiber of claim 14, including a pair of outer electrodes, each extending along an outer surface of the elongate core, and an at least partially light transmitting isolating coating at least partially enclosing the electrodes.

16. The filament or fiber of claim 15, wherein the outer electrodes are entwined, and extend substantially helically along the core.

17. The filament or fiber of claim 14, wherein the outer sheath includes an outer electrode.

18. A filament or fiber of claim 17, including one or more spacers that are configured to provide a distance between the outer electrode and the inner electrode.

19. The filament or fiber of claim 17, wherein the outer electrode includes a conductive polymer.

20. The filament or fiber of claim 17, wherein the outer electrode is transparent.

21. The filament or fiber of claim 17, wherein the outer electrode is flexible.

22. The filament or fiber of claim 1, including one or more spacers that are configured to provide a distance between the outer sheath and the inner electrode.

23. The filament or fiber of claim 22, wherein the one or more spacers include one or more spacer wires extending substantially axially through the core.

24. The filament or fiber of claim 22, wherein the spacers include a plurality of substantially spherical beads.

25. The filament or fiber of claim 24, wherein the substantially spherical beads are contained within the substance.

26. The filament or fiber of claim 22, wherein the one or more spacers include one or more spacer wires extending helically along the inner electrode.

27. The filament or fiber of claim 22, wherein the one or more spacers are substantially non-conductive.

28. The filament or fiber of claim 1, including a color layer on the inner electrode.

29. A garment formed from a plurality of the filaments or fibers of claim 1.

30. A textile formed from a plurality of the filaments or fibers of claim 1.

* * * * *